US009289668B2

(12) United States Patent
Gilman

(10) Patent No.: US 9,289,668 B2
(45) **Date of Patent: *Mar. 22, 2016**

(54) SKIS AND HANDLEBAR ACCESSORIES FOR ATHLETIC TRAINING SLEDS

(71) Applicant: MARTY GILMAN, INC., Gilman, CT (US)

(72) Inventor: Neil F. Gilman, South Glastonbury, CT (US)

(73) Assignee: MARTY GILMAN, INC., Gilman, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/143,597

(22) Filed: Dec. 30, 2013

(65) Prior Publication Data

US 2014/0221131 A1 Aug. 7, 2014

Related U.S. Application Data

(63) Continuation of application No. 12/981,088, filed on Dec. 29, 2010, now Pat. No. 8,617,007.

(51) Int. Cl.
*A63B 69/34* (2006.01)
*A63B 69/00* (2006.01)

(52) U.S. Cl.
CPC ..... *A63B 69/0071* (2013.01); *A63B 69/00* (2013.01); *A63B 69/004* (2013.01); *A63B 69/345* (2013.01); *A63B 2243/0037* (2013.01)

(58) Field of Classification Search
CPC .. A63B 69/00; A63B 69/0071; A63B 69/002; A63B 69/004; A63B 69/345; A63B 63/34
USPC ..... 473/422, 445, 441, 440, 438; 434/253; 482/90, 93–95, 14; D21/534, 788, 791, D21/767
See application file for complete search history.

(56) References Cited

U.S. PATENT DOCUMENTS

| | | | | |
|---|---|---|---|---|
| 2,209,830 | A | 7/1940 | Saari | |
| 2,237,600 | A * | 4/1941 | Gilman | 473/445 |
| 2,248,214 | A | 7/1941 | Bleecker | |
| 2,558,081 | A | 6/1951 | Gardenhour | |
| 3,014,731 | A | 12/1961 | Dworak | |
| 3,061,326 | A | 10/1962 | Rasmussen | |
| 3,355,186 | A | 11/1967 | Bradley | |
| 3,380,084 | A | 4/1968 | Savage | |
| 3,425,692 | A | 2/1969 | Leach | |
| 3,438,302 | A * | 4/1969 | Sandor | 411/80.2 |
| 3,528,674 | A | 9/1970 | Schwarz | |
| 3,606,366 | A | 9/1971 | Engelberger | |
| 3,712,396 | A | 1/1973 | Ende | |
| 3,734,523 | A | 5/1973 | Field | |
| 3,804,410 | A * | 4/1974 | Gilman | 473/445 |
| 4,453,742 | A | 6/1984 | Zepkowski | |
| 4,682,781 | A | 7/1987 | Dickens | |

(Continued)

*Primary Examiner* — Mitra Aryanpour
(74) *Attorney, Agent, or Firm* — Day Pitney LLP

(57) ABSTRACT

A training sled including a pair of nonlinear runners is disclosed arranged in parallel relative to a center axis and a plane. A head crossbar may extend between first ends of the runners and may be joined thereto so as to form a U-shaped member with the runners. A weight bearing member may be affixed to and extend between the pair of nonlinear runners near mid-sections thereof. A rear crossbar may extend between and may be disposed above the plane of the runners proximate second ends thereof and may be joined thereto opposite the head crossbar.

18 Claims, 5 Drawing Sheets

(56) References Cited

U.S. PATENT DOCUMENTS

| | | | | | |
|---|---|---|---|---|---|
| 4,802,670 | A | | 2/1989 | Smith | |
| 4,890,495 | A | | 1/1990 | Slane | |
| 5,385,523 | A | | 1/1995 | Forrest | |
| 5,397,154 | A | | 3/1995 | Baldwin | |
| D377,507 | S | * | 1/1997 | Thomas, Sr. | D21/534 |
| D390,500 | S | * | 2/1998 | Walker | D12/9 |
| 6,036,609 | A | * | 3/2000 | Gilman | 473/445 |
| D466,963 | S | | 12/2002 | Forrest | |
| D469,142 | S | | 1/2003 | Forrest | |
| 6,612,971 | B1 | | 9/2003 | Morris | |
| 6,685,581 | B2 | | 2/2004 | Krause et al. | |
| 6,942,585 | B1 | | 9/2005 | Krause | |
| 7,322,893 | B2 | | 1/2008 | Bright | |
| D606,611 | S | | 12/2009 | Rogers et al. | |
| D659,779 | S | | 5/2012 | Gray | |
| 2008/0312009 | A1 | * | 12/2008 | Gilman | 473/445 |
| 2011/0124474 | A1 | * | 5/2011 | Gilman | 482/93 |
| 2012/0172155 | A1 | * | 7/2012 | Gilman | 473/447 |
| 2013/0184104 | A1 | * | 7/2013 | Gilman | 473/445 |

* cited by examiner

SKIS AND HANDLEBAR ACCESSORIES FOR ATHLETIC TRAINING SLEDS

CROSS-REFERENCE TO RELATED APPLICATION

This patent application is a continuation of and claims the benefit of priority to U.S. patent application Ser. No. 12/981,088, filed Dec. 29, 2010. The aforementioned patent application is incorporated by reference herein in its entirety for any purpose whatsoever.

FIELD OF THE DISCLOSURE

The invention relates generally to sports-related training equipment and devices, particularly, training devices that enable training for speed, strength and agility, and accessories for same.

BACKGROUND

It is generally accepted that the better prepared a sports team is, the more successful they will be at the game. While many factors affect a team's preparedness, the training equipment available to a team has traditionally been considered critical. Consequently, training equipment has continued to evolve, as players and teams attempt to gain a competitive advantage over opponents. This evolution has resulted in a closer approximation of "game-like" conditions for the athletes during practices. Simulating game-like conditions has allowed the players to finely tune their skills in ways that directly translate into increased "on-the-court" performance. In sports where speed, strength and agility are key, such as in basketball, it is highly desirable to train athletes using exercises and equipment that simulate play while building strength and agility. Additionally, while a variety of athletic training sleds exist for use in training for football, those sleds would not be appropriate for use on a wood, concrete or asphalt basketball court surface.

Accordingly, a need exists for a training device that provides a trainee with a tool for speed, agility and strength training that can be used on the basketball court. Additionally, there exists a need for an accessory that can be used to convert a football training sled for use on a basketball court.

SUMMARY OF THE DISCLOSURE

In an embodiment, a training sled includes a pair of nonlinear runners of tubular construction arranged in parallel relative to a center axis and a plane. A head crossbar (e.g., of tubular construction) may extend between first ends of the runners and may be joined thereto so as to form a continuous tubular U-shaped member with the runners. A weight bearing member may be affixed to and extend between the pair of nonlinear runners near mid-sections thereof. A rear crossbar (e.g., of tubular construction) may extend between and may be disposed above the plane of the runners proximate second ends thereof and may be joined thereto opposite the head crossbar, so as to present a rearward facing surface against which force may be applied. A pair of skis may be configured to removably attach to the training sled.

One or more of the following features may be included. A friction-reducing layer may be disposed on a bottom portion of each of the pair of skis. The friction-reducing layer may be a high density carpet-like material. A ski head crossbar may extend between head ends of the pair of skis. A ski rear crossbar may extend between rear ends of the pair of skis. A left attachment arm may be disposed on an inner portion of a left ski of the pair of skis. A right attachment arm may be disposed on an inner portion of a right ski of the pair of skis. The left attachment arm and the right attachment arm may be configured to removably attach to the weight bearing member. The left attachment arm and the right attachment arm may include a gripping sleeve configured to grip the weight bearing member. A locking pin system may be configured to secure the pair of skis to the training sled. A first pair of rollers may be disposed proximate to the head ends of the pair of skis. A second pair of rollers may be disposed proximate to the rear ends of the pair of skis.

The training sled may include a removable handlebar. A pair of posts may be disposed on the second ends of the runners. The pair of posts may be configured to removably receive the removable handlebar. The handlebar may present a rearward facing surface against which force may be applied in a range from 8 inches to 40 inches above the plane of the runners. The removable handlebar may include an attachment crossbar configured to removably mate with the pair of posts disposed on the second ends of the runners. The removable handlebar may further include an upper grip bar having a pair of substantially L-shaped legs. The pair of substantially L-shaped legs may be operably connected to the attachment crossbar. The removable handlebar may include a left grip bar disposed on an upper left portion of the upper grip bar and a right grip bar disposed on an upper right portion of the upper grip bar.

The removable handlebar may alternatively include an attachment crossbar configured to removably mate with the pair of posts disposed on the second ends of the runners. A pair of L-shaped legs may be operably attached at first ends thereof to the attachment crossbar. A substantially straight grip bar may be operably attached to second ends of the pair of L-shaped legs.

The removable handlebar may alternatively include an attachment crossbar configured to removably mate with the pair of posts disposed on the second ends of the runners. A left-flared grip bar having an L-shaped lower portion may be operably attached to the attachment crossbar. A right-flared grip bar having an L-shaped lower portion may be operably attached to the attachment crossbar. An upper crossbar may extend between and be operably attached to the left-flared grip bar and the right-flared grip bar.

The training sled may include an attachment mechanism operably attached to the head crossbar configured for securing one of ropes, cables and straps to the training sled. The weight bearing member may have a substantially flat rectangular profile and may further include a cylindrical horn extending normal thereto on which weights may be removably mounted.

In another embodiment, a ski accessory for an athletic training sled includes a pair of nonlinear skis arranged in parallel relative to a center axis and a plane. A friction-reducing layer may be disposed on a bottom portion of each of the pair of skis. A ski head crossbar may extend between head ends of the pair of skis. A ski rear crossbar may extend between rear ends of the pair of skis. A left attachment arm may be disposed on an inner portion of a left ski of the pair of skis. A right attachment arm may be disposed on an inner portion of a right ski of the pair of skis. The left attachment arm and the right attachment arm may be configured to removably attach to an athletic training sled.

One or more of the following features may be included. The friction-reducing layer may be a high density carpet-like material. The ski accessory for an athletic training sled may include a locking pin system configured to secure the pair of skis to the athletic training sled. A first pair of rollers may be disposed proximate to the head ends of the pair of skis. A second pair of rollers may be disposed proximate to the rear ends of the pair of skis. The left attachment arm and the right attachment arm may include a gripping sleeve configured to grip a portion of the athletic training sled.

The details of one or more embodiments are set forth in the accompanying drawings and the description below. Other features and advantages will become apparent from the description, the drawings and the claims.

BRIEF DESCRIPTION OF THE DRAWINGS

Like reference numbers and designations in the various drawings indicate like elements.

SUMMARY OF THE DISCLOSURE

A training sled according to various embodiments described herein enables a trainee to develop power, speed and agility. The elevated handlebars allow a trainee to drive and pull the training sled in postures that realistically simulate game conditions, thereby helping the trainee to develop strength and power in the knees, ankles and hips. The training sled can be driven from either the lower rear crossbar level or from a higher level through use of a removable handlebar. Weight sleds and accessories embodying various aspects of the training sled and ski and handlebar accessories described herein are commercially available as the Crab Sled, King Crab Sled and Ski Runners from Marty Gilman, Inc., Gilman, Conn.

Figure 1:
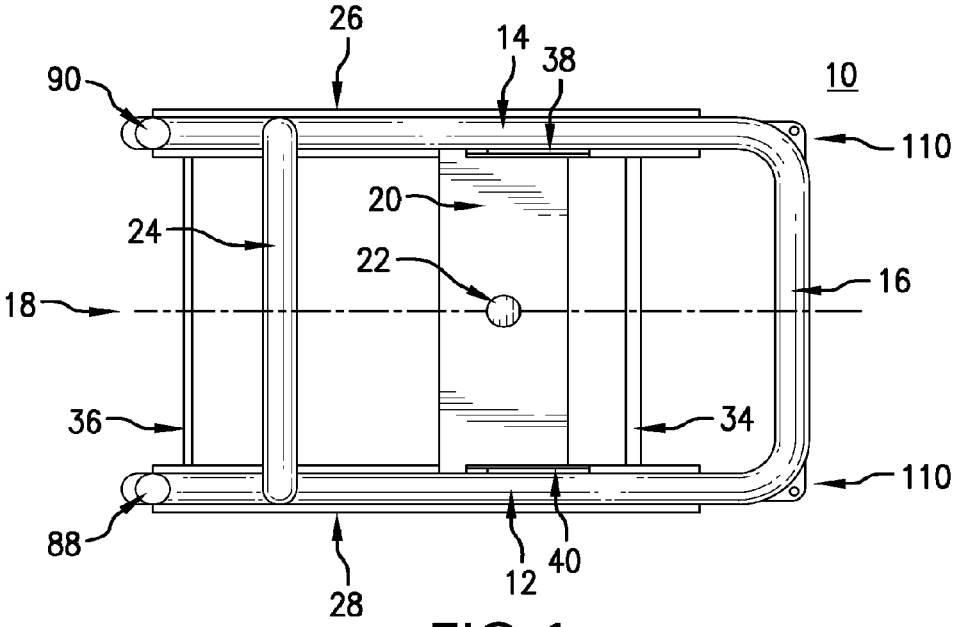
FIG. 1 is a top view of an embodiment of an athletic training sled.
Figure 2:
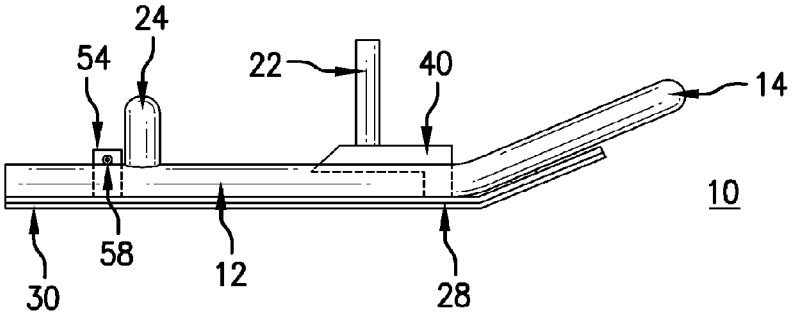
FIG. 2 is a side view of an embodiment of an athletic training sled.

As seen in FIGS. 1 and 2, an exemplary training sled 10 may include a pair of nonlinear runners 12 and 14 of tubular construction arranged in parallel relative to a center axis and a plane. A head crossbar 16 of tubular construction may extend between first ends of the runners and may be joined thereto so as to form a continuous tubular U-shaped chassis with the runners 12 and 14. Each of the runners 12 and 14 and head crossbar 16 may be formed of rigid material, such as aluminum or steel pipe, and may have a substantially tubular construction. For example, the rigid, substantially tubular material used to form the various parts of the training sled 10 may have a diameter in the range of 1 to 3 inches and a wall thickness of approximately ¼-inch. The runners 12 and 14 may be arranged parallel to each other and to a hypothetical center axis 18. As shown in FIG. 2, each of the runners 12 and 14 may have a substantially straight section and a section that is bent at an upward angle relative to the straight section. As a result, from a plan or side view, runners 12 and 14 may appear to have a nonlinear profile. Head crossbar 16 may be substantially straight and may join runners 12 and 14 at their respective upward bent ends. In one embodiment, the U-shaped chassis formed by the runners 12 and 14 and the head crossbar 16 may include individual tubular pieces mechanically joined by welding or any number of techniques known in the arts, or, alternatively, may be formed from a single piece of tubing, so that the sled 10 has a unitary body.

A weight bearing member 20 may be affixed to and extend between the pair of nonlinear runners 12 and 14 near mid-sections thereof. The weight bearing member 20 may be implemented with a substantially flat rectangular plate also formed of a rigid material such as aluminum or steel and may extend between the runners 12 and 14 approximately adjacent the respective bent sections thereof, as shown in FIG. 1. The weight bearing member 20 may be mechanically joined to the runners 12 and 14 by welding or other techniques known in the arts so as to form a unitary body therewith. The substantially flat surface presented by the weight bearing member 20 provides an area on which to removably mount weights. A weight horn 22 having a generally cylindrical shape and also made of substantially rigid material may be secured to the weight bearing surface of the weight bearing member 20 at a right angle thereto. The weight horn 22 may be implemented with aluminum tubing similar to the runners 12 and 14. The diameter of the weight horn 22 may be chosen to accommodate the hole in standard weight sets, and may be chosen to have a height which enables vertical stacking of several plates of weights onto weight bearing member 20.

A rear crossbar 24 of tubular construction may extend between and may be disposed above the plane of the runners 12 and 14 proximate second ends thereof and may be joined to the runners 12 and 14 opposite from the head crossbar 16, so as to present a rearward facing surface against which force may be applied. The rear crossbar 24 may extend between the respective straight sections of the runners 12 and 14 and may be implemented with aluminum tubing similar to the runners 12 and 14. The rear crossbar 24 may also be mechanically joined by welding or other techniques to the runners 12 and 14 so as to form a unitary body therewith. The rear crossbar 24 may present a rearward facing surface against which a trainee may apply force during a training exercise. The height of the rear crossbar 24 relative to the ground or other surface on which the training sled 10 rests may be chosen to allow the sled 10 to be driven at the bear crawl level, approximately 8 to 12 inches off the ground.

A pair of nonlinear skis 26 and 28 may be configured to removably attach to the training sled 10. The skis 26 and 28 may be arranged in parallel relative to a center axis and a plane. The skis 26 and 28 may be of substantially flat construction and may be formed of a rigid material, such as aluminum or steel. The skis 26 and 28 may have a substantially straight section and a section that is bent at an upward angle relative to the straight section, such that the skis 26 and 28 are formed to follow the contours of the runners 12 and 14.

Figure 3:
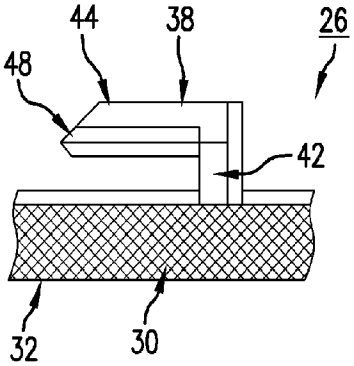
FIG. 3 illustrates a bottom perspective view of an embodiment of a portion of a pair of skis configured for attachment to an athletic training sled.

As shown in FIG. 3, the skis 26 and 28 may include a friction-reducing layer 30 disposed on a bottom portion 32 of each of the pair of skis 26 and 28. The friction-reducing layer 30 may be attached to the skis using conventional methods, such as by glue or other adhesive. Alternatively, the friction-reducing layer 30 may be attached to the skis using mechanical attachment mechanisms known in the art, such as snaps or hooks disposed on top, side or bottom portions of the skis 26 and 28 to which corresponding snaps or eyelets on the friction reducing layer 30 may attach. The friction-reducing layer 30 may be a high density carpet-like material, leather, chamois, fibrous textile pile or other similar material that would enable the sled 10 with skis 26 and 28 attached to travel over a hard surface with little to no resistance or friction.

Figure 4:
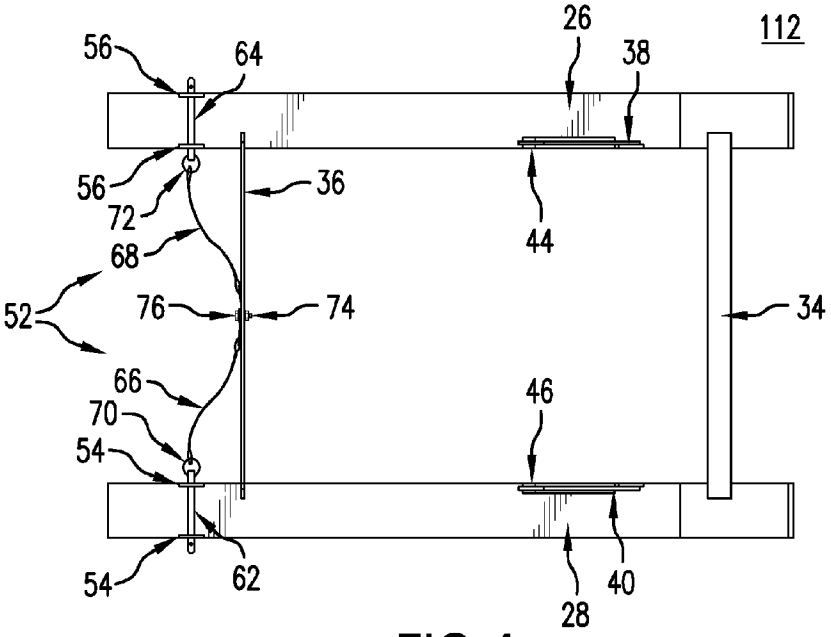
FIG. 4 is a top view of an embodiment of a pair of skis configured for attachment to an athletic training sled.

As shown in FIGS. 1 and 4, a ski head crossbar 34 may extend between head ends of the pair of skis 26 and 28. The ski head crossbar 34 may be implemented with a substantially flat rectangular bar formed of a rigid material such as aluminum or steel and may extend between the skis 26 and 28 approximately adjacent the respective bent sections thereof. The ski head crossbar 34 may be mechanically joined to the skis 26 and 28 by welding or other techniques known in the arts so as to form a unitary body therewith.

A ski rear crossbar 36 may extend between rear ends of the pair of skis 26 and 28. The ski rear crossbar 36 may be implemented with a substantially flat rectangular bar formed of a rigid material such as aluminum or steel and may extend between straight sections of the skis 26 and 28 approximately adjacent the respective rear ends thereof. The ski rear crossbar 36 may be mechanically joined to the skis 26 and 28 by welding or other techniques known in the arts so as to form a unitary body therewith. Placement of the ski rear crossbar 36 on the skis may vary depending upon whether the skis are designed for a sled with a removable handlebar (see, e.g., FIG. 12) or for a sled without a removable handlebar (see, e.g., FIG. 13).

A left attachment arm 38 may be disposed on an inner portion of the left ski 26 of the pair of skis 26 and 28. Similarly, a right attachment arm 40 may be disposed on an inner portion of the right ski 28 of the pair of skis 26 and 28. The left and right attachment arms 38 and 40 may be formed of a rigid material such as aluminum or steel. The left and right attachment arms 38 and 40 may be configured such that a leg portion (for example, leg portion 42) of each attachment arm 38 and 40 is mechanically joined to respective inner portions of the skis 26 and 28, such as by welding or other techniques known in the arts. A hp portion 44 and 46 of each attachment arm 38 and 40 may be mechanically joined to the leg portion 42 of each of the left and right attachment arms 38 and 40, or, alternatively, the lip and leg portions may be formed from a single piece of aluminum or steel, so that the attachment arms 38 and 40 are a unitary body.

The left attachment arm 38 and the right attachment arm 40 may be configured to removably attach to the weight bearing member 20. For example, the lip portions 44 and 46 may be configured to attach to and/or grip at least a portion of the training sled 10, such as the weight bearing member 20. The left and right attachment arms 38 and 40 may be disposed on the skis 26 and 28 such that, when the skis 26 and 28 are slid into place under the training sled 10, the lip portions 44 and 46 extend over the weight bearing member 20 toward the rear ends of the skis 26 and 28, and the weight bearing member may rest or press against the leg portions, thereby removably holding or gripping the skis 26 and 28 in place on the sled 10 as the sled 10 is driven or pulled forward.

The left attachment arm 38 and the right attachment arm 40 may each include a gripping sleeve 48 and 50 configured to grip the weight bearing member 20. The gripping sleeves 48 and 50 may be formed of rubber or other material capable of gripping or removably attaching to and holding at least a portion of the training sled 10, such as the weight bearing member 20. The gripping sleeves 48 and 50 may be operably attached to the left and right attachment arms 38 and 40 by conventional means, such as by glue or other adhesive. Alternatively, the gripping sleeves 48 and 50 may be mechanically attached to the left and right attachment arms 38 and 40 by any number of techniques known in the art. For example, the left and right attachment arms 38 and 40 may include a projection (not shown) over which an aperture (not shown) in the gripping sleeves 48 and 50 may be disposed, such that each gripping sleeve may be held in place by attachment to a projection.

As shown in FIG. 4, a locking pin system 52 may be configured to secure the pair of skis 26 and 28 to the training sled 10. The locking pin system 52 may include a pair of flanges 54 and 56 disposed proximate rear ends of each of the pair of skis 26 and 28 such that, when the skis 26 and 28 are slid into place under the training sled 10, the runners 12 and 14 each sit between a pair of flanges 54 and 56. The pairs of flanges 54 and 56 may be implemented with substantially flat rectangular plates formed of a rigid material such as aluminum or steel. The pairs of flanges 54 and 56 may be mechanically joined to the skis 26 and 28 by welding or other techniques known in the arts. Each of the flanges may include an aperture (for example, apertures 58 and 60 shown in FIGS. 2 and 5) configured to receive a pin. Each of the pairs of flanges 54 and 56 may be sized such that the apertures 58 and 60 are disposed above the runners when the skis 26 and 28 are slid into place under the training sled 10, thereby enabling placement of the pins 62 and 64 in the apertures 58 and 60 over the runners 12 and 14, further securing attachment of the skis 26 and 28 to the sled 10. Placement of the flanges 54 and 56 on the skis may vary depending upon whether the skis are designed for a sled with a removable handlebar (see, e.g., FIG. 12) or for a sled without a removable handlebar (see, e.g., FIG. 13). As shown in FIG. 4, pins 62 and 64 may be operably attached to cables 66 and 68, such as by rings 70 and 72. The cables 66 and 68 may be operably attached to the ski rear crossbar 36, such as by nut 74 and bolt 76 or other conventional mechanical attachment mechanism.

Figure 5:
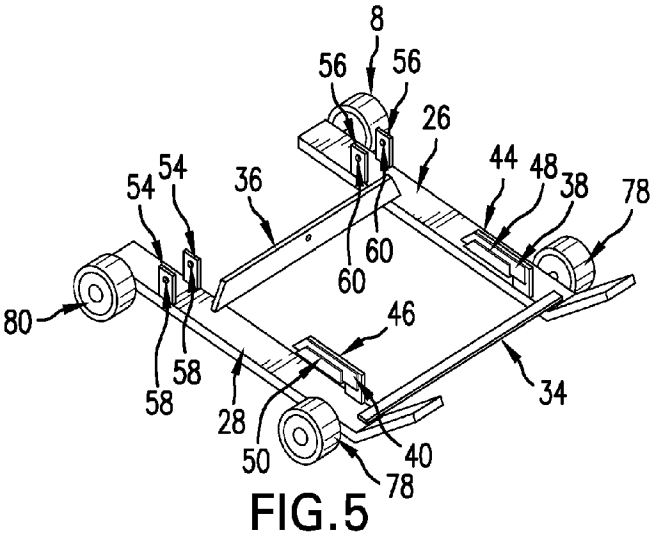
FIG. 5 is a perspective view of an embodiment of a pair of skis with front and rear rollers configured for attachment to an athletic training sled.

As shown in FIG. 5, a first pair of rollers 78 may be disposed proximate to the head ends of the pair of skis 26 and 28 and a second pair of rollers 80 may be disposed proximate to the rear ends of the pair of skis 26 and 28. The rollers 78 and 80 may be formed of a substantially hard material such as polyurethane or other hard rubber or plastic material capable of enabling smooth, low-friction travel over hard surfaces such as concrete or asphalt. The rollers 78 and 80 may be mechanically attached to the pair of skis 26 and 28 by a variety of conventional means known in the art. For example, the rollers 78 and 80 may be operably attached to an L-shaped bracket and the L-shaped bracket may be operably attached, such as by welding, bolting or other mechanical attachment mechanism, to the skis 26 and 28.

Figure 6:
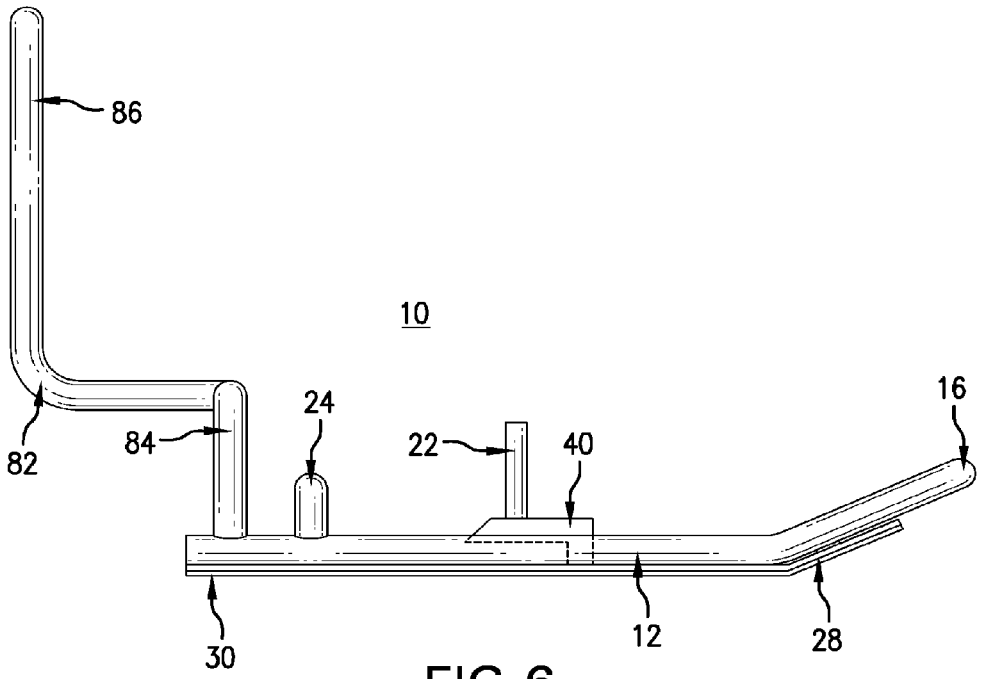
FIG. 6 is a side view of an athletic training sled with skis and handlebars.
Figure 7:
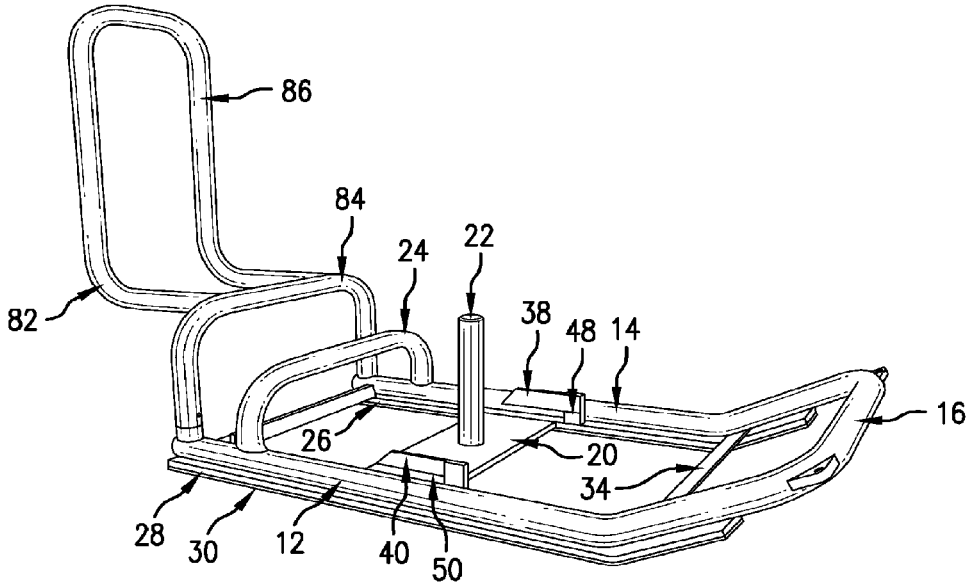
FIG. 7 is a perspective view of an athletic training sled with skis and handlebars.

As shown in FIGS. 6 and 7, the training sled 10 may include a removable handlebar, for example, handlebar 82. Similar to the runners 12 and 14 and the head and rear crossbar 16 and 24, the removable handlebar may be formed of rigid material, such as aluminum or steel pipe, and may have a substantially tubular construction.

The removable handlebar 82 may include a generally U-shaped attachment crossbar 84 and a generally U-shaped upper grip bar 86 joined together to form a unitary body that may be selectively attachable/detachable to/from training sled 10. In alternative embodiments, the attachment crossbar 84 and grip bar 86 may be parabolic, arch-shaped, curved or of other similar shape configured to enable a user to grip the removable handlebar 82 at a variety of heights and apply force to the sled 10. The upper portions of the legs of the upper grip bar 86 may be parallel and spaced more narrowly, for example, 13 inches apart, than the distance between the runners 12 and 14. The upper grip bar 86 may present a range of vertical heights at which a trainee may grab the legs with a thumbs-up grip. As shown in FIG. 6, the upper grip bar 86 may have a pair of substantially L-shaped legs that may be bent at a right angle such that the upper grip bar 86 has a substantially L-shaped profile from the side.

The pair of substantially L-shaped legs of the upper grip bar 86 may be operably connected to the attachment crossbar 84. For example, the legs of the upper grip bar 86 may be mechanically joined by welding or other techniques to the attachment crossbar 84 so as to form a unitary body therewith. The attachment crossbar 84, in turn, may be removably mounted to the sled 10 near the second ends of runners 12 and 14, rearward of the rear crossbar 24. The L-shaped side profile of the upper grip bar 86 may enable the force applied to upper grip bar 86 to be transferred to the sled 10 at a point which is more proximate the center of gravity of the sled 10.

As shown in FIG. 1, a pair of posts 88 and 90 may be disposed on the second ends of the runners 12 and 14. The pair of posts 88 and 90 may be configured to removably receive the removable handlebar 82. For example, the attachment crossbar 84 may be configured to removably mate with the pair of posts 88 and 90. The pair of posts 88 and 90 may be affixed to, such as by welding, and project upwardly from the rear ends of the runners 12 and 14, respectively, and may be shaped and sized to receive the open hollow ends of the legs of the attachment crossbar 84 in a complementary mating matter. The removable handlebar 82, therefore, may be manually and rapidly attached to or removed from the training sled 10, without the need for tools.

The removable handlebar 82 may present a rearward facing surface against which a trainee may apply force during a training exercise. The height of the removable handlebar 82 relative to the ground or other surface on which the sled 10 rests may be chosen to allow the sled to be driven from a range of levels from a lower bear crawl to a higher two-point stance and takeoffs. In an embodiment, when attached to the sled 10, the upper grip bar 86 of the removable handlebar 82 may have a height of approximately 8 to 40 inches from the plane of the runners 12 and 14. As such, the removable handlebar 82 may allow a trainee to drive the sled in a range of postures that enable strength, speed and agility training.

Figure 8:
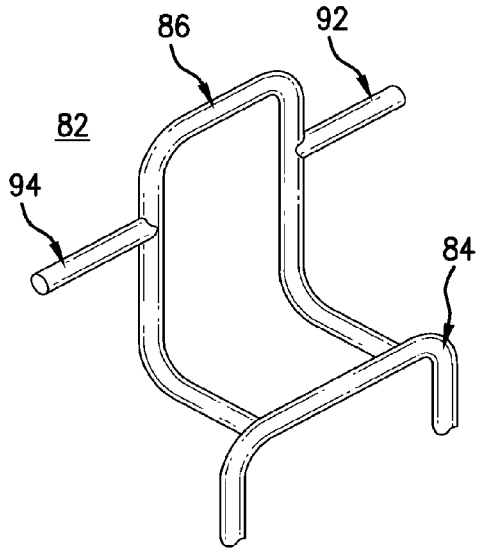
FIG. 8 is a perspective view of an embodiment of removable handlebars configured for attachment to an athletic training sled.
Figure 9:
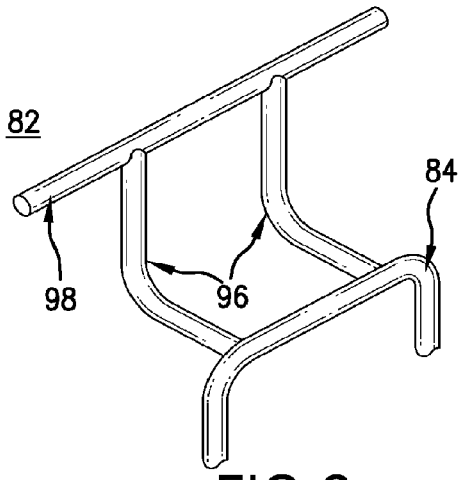
FIG. 9 is a perspective view of another embodiment of removable handlebars configured for attachment to an athletic training sled.
Figure 10:
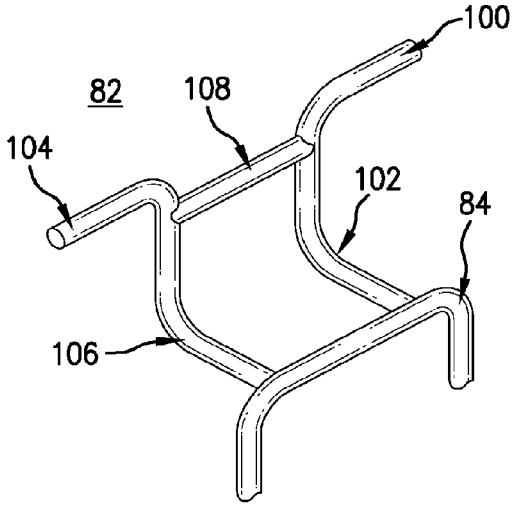
FIG. 10 is a perspective view of another embodiment of removable handlebars configured for attachment to an athletic training sled.

As shown in FIGS. 8-10, the removable handlebar 82 may have a variety of alternate configurations and embodiments for the upper grip bar 86 portion of the removable handlebar 82. In an embodiment, shown in FIG. 8, the removable handlebar 82 may include a left grip bar 92 disposed on an upper left portion of the upper grip bar 86 and a right grip bar 94 disposed on an upper right portion of the upper grip bar 86. The left and right grip bars 92 and 94 may be formed of rigid material, such as aluminum or steel pipe, and may have a substantially tubular construction. The left and right grip bars 92 and 94 may be mechanically attached to the upper grip bar 86 by welding or other known techniques so as to form a unitary body therewith.

In another embodiment, as shown in FIG. 9, in addition to the to the attachment crossbar 84 configured to removably mate with the pair of posts 88 and 90 disposed on the second ends of the runners 12 and 14, as described above, the removable handlebar 82 may alternatively include a pair of L-shaped legs 96 that may be operably attached at first ends thereof to the attachment crossbar 84. A substantially straight grip bar 98 may be operably attached to second ends of the pair of L-shaped legs 96. The pair of L-shaped legs 96 and the grip bar 98 may be formed of rigid material, such as aluminum or steel pipe, and may have a substantially tubular construction. The pair of L-shaped legs 96 may be mechanically attached to the attachment crossbar 84 by welding or other known techniques so as to form a unitary body therewith. Similarly, the substantially straight grip bar 98 may be mechanically attached to the pair of L-shaped legs 96 by welding or other known techniques so as to form a unitary body therewith.

As shown in FIG. 10, in addition to the to the attachment crossbar 84 configured to removably mate with the pair of posts 88 and 90 disposed on the second ends of the runners 12 and 14, as described above, the removable handlebar 82 may alternatively include a left-flared grip bar 100 having an L-shaped lower portion 102 that may be operably attached to the attachment crossbar 84. Similarly, a right-flared grip bar 104 having an L-shaped lower portion 106 may be operably attached to the attachment crossbar 84. The left-flared grip bar 100 and right-flared grip bar 104 may be mechanically attached to the attachment crossbar 84 at first ends of the L-shaped lower portions 102 and 106 by welding or other known techniques so as to form a unitary body therewith. An upper crossbar 108 may extend between and be operably attached to the left-flared grip bar 100 and the right-flared grip bar 104. The upper crossbar 108 may be mechanically attached to the left-flared grip bar 100 and right-flared grip bar 104 on vertical portions of the L-shaped lower portions 102 and 106 proximate outward flared portions of the left-flared grip bar 100 and the right-flared grip bar 104 by welding or other known techniques so as to form a unitary body therewith. The left-flared grip bar 100, right-flared grip bar 104 and upper crossbar 108 may be formed of rigid material, such as aluminum or steel pipe, and may have a substantially tubular construction.

As shown in FIG. 1, the training sled 10 may include an attachment mechanism no operably attached to the head crossbar 16 configured for securing one of ropes, cables and/or straps to the training sled 10. For example, a pair of front attachment mechanisms 110, implemented with eyelets welded to sled 10, may be disposed at the corners of sled 10 to facilitate attachment of straps, ropes, cords, chains, etc., which may in turn be attached to a harness, to allow the trainee to also drag or pull the sled 10, in addition to being able to push the sled from the rear. Alternatively, a single eyelet may be welded to a central portion of head crossbar 16 (not shown).

Figure 11:
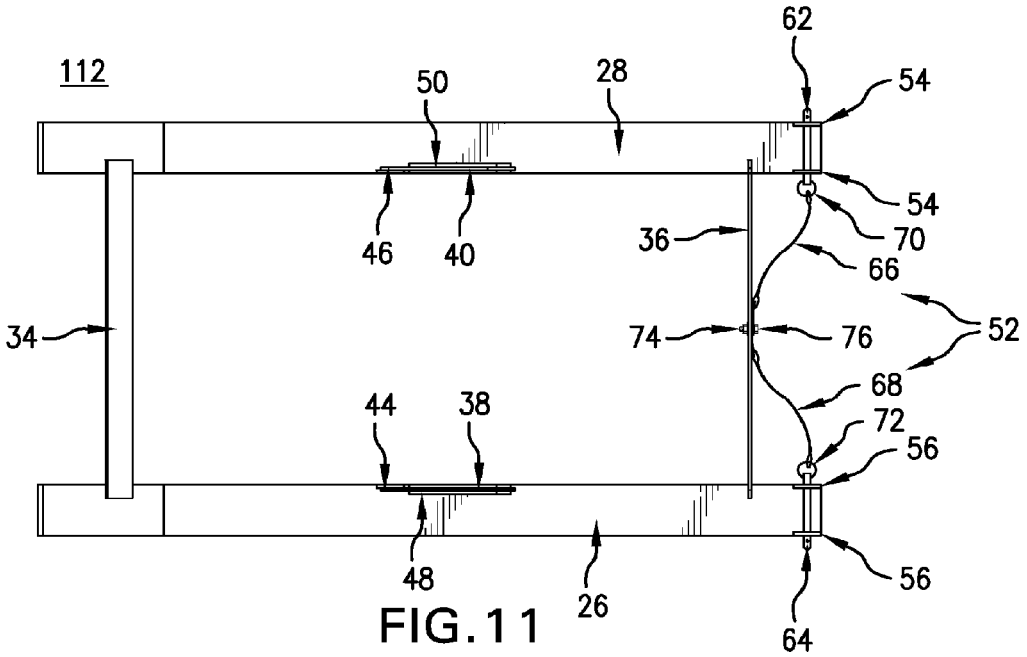
FIG. 11 is a top view of an embodiment of a ski accessory configured for attachment to an athletic training sled.
Figure 12:
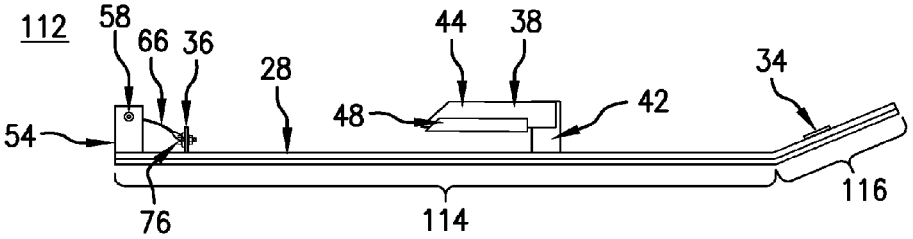
FIG. 12 is a side view of an embodiment of a ski accessory configured for attachment to an athletic training sled.
Figure 13:
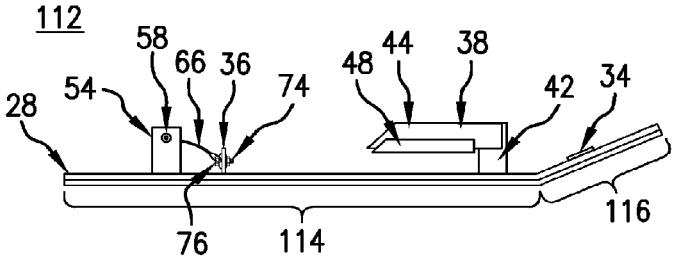
FIG. 13 is a side view of another embodiment of a ski accessory configured for attachment to an athletic training sled. elements.

Referring to FIGS. 4 and 11-13, in another embodiment, a ski accessory 112 for an athletic training sled (for example, sled 10) includes a pair of nonlinear skis 26 and 28 arranged in parallel relative to a center axis and a plane. As shown in FIGS. 12 and 13, the ski accessory 112 may be sized and laid out differently depending upon whether the ski accessory 112 is made to fit a sled designed for a removable handlebar (FIG. 12) or for a sled without a removable handlebar (FIG. 13), or for any other reasons which might influence the length and layout of the sled and, therefore, the ski accessory 112. The skis 26 and 28 may be of substantially flat construction and may be formed of a rigid material, such as aluminum or steel. The skis 26 and 28 may have a substantially straight section 114 and a section that is bent at an upward angle relative to the straight section 116, such that the skis 26 and 28 are formed to follow the contours of the runners 12 and 14 of a training sled 10.

As shown in FIG. 3, the skis 26 and 28 may include a friction-reducing layer 30 disposed on a bottom portion 32 of each of the pair of skis 26 and 28. The friction-reducing layer 30 may be attached to the skis using conventional methods, such as by glue or other adhesive. Alternatively, the friction-reducing layer 30 may be attached to the skis using mechanical attachment mechanisms known in the art, such as snaps or hooks disposed on top, side or bottom portions of the skis 26 and 28 to which corresponding snaps or eyelets on the friction reducing layer 30 may attach. The friction-reducing layer 30 may be a high density carpet-like material, leather, chamois, fibrous textile pile or other similar material that would allow the sled 10 with skis 26 and 28 attached to travel over a hard surface with little to no resistance or friction.

As shown in FIGS. 4 and 11, a ski head crossbar 34 may extend between head ends of the pair of skis 26 and 28. The ski head crossbar 34 may be implemented with a substantially flat rectangular bar formed of a rigid material such as aluminum or steel and may extend between the skis 26 and 28 approximately adjacent the respective bent sections thereof. The ski head crossbar 34 may be mechanically joined to the skis 26 and 28 by welding or other techniques known in the arts so as to form a unitary body therewith.

A ski rear crossbar 36 may extend between rear ends of the pair of skis 26 and 28. The ski rear crossbar 36 may be implemented with a substantially flat rectangular bar formed of a rigid material such as aluminum or steel and may extend between straight sections of the skis 26 and 28 approximately adjacent the respective rear ends thereof. The ski rear crossbar 36 may be mechanically joined to the skis 26 and 28 by welding or other techniques known in the arts so as to form a unitary body therewith. Placement of the ski rear crossbar 36 on the skis may vary depending upon whether the skis are designed for a sled with a removable handlebar (see, e.g., FIG. 12) or for a sled without a removable handlebar (see, e.g., FIG. 13).

A left attachment arm 38 may be disposed on an inner portion of the left ski 26 of the pair of skis 26 and 28. Similarly, a right attachment arm 40 may be disposed on an inner portion of the right ski 28 of the pair of skis 26 and 28. The left and right attachment arms 38 and 40 may be formed of a rigid material such as aluminum or steel. The left and right attachment arms 38 and 40 may be configured such that a leg portion (for example, leg portion 42 shown in FIGS. 3, 12 and 13) of each attachment arm 38 and 40 is mechanically joined to respective inner portions of the skis 26 and 28, such as by welding or other techniques known in the arts. A lip portion 44 and 46 of each attachment arm 38 and 40 may be mechanically joined to the leg portion 42 of each of the left and right attachment arms 38 and 40, or, alternatively, the lip and leg portions may be formed from a single piece of aluminum or steel, so that the attachment arms 38 and 40 are a unitary body.

The left attachment arm 38 and the right attachment arm 40 may be configured to removably attach to an athletic training sled, for example training sled 10. For example, the lip portions 44 and 46 may be configured to attach to and/or grip at least a portion of a weight bearing member or other crossbar that may be disposed on the sled. The left and right attachment arms 38 and 40 may be disposed on the skis 26 and 28 such that, when the skis 26 and 28 are slid into place under a training sled, the lip portions 44 and 46 extend over the weight bearing member or other crossbar toward the rear ends of the skis 26 and 28, and the weight bearing member or crossbar may rest or press against the leg portions, thereby removably holding the skis 26 and 28 in place on the sled as the sled is driven or pulled forward.

The left attachment arm 38 and the right attachment arm 40 may each include a gripping sleeve 48 and 50 configured to grip weight bearing member or other crossbar on a training sled. The gripping sleeves 48 and 50 may be formed of rubber or other material capable of gripping or removably adhering to at least a portion of the training sled, such as the weight bearing member or other crossbar. The gripping sleeves 48 and 50 may be operably attached to the left and right attachment arms 38 and 40 by conventional means, such as by glue or other adhesive. Alternatively, the gripping sleeves 48 and 50 may be mechanically attached to the left and right attachment arms 38 and 40 by any number of techniques known in the art. For example, the left and right attachment arms 38 and 40 may include a projection (not shown) over which an aperture (not shown) in the gripping sleeves 48 and 50 may be disposed, such that each gripping sleeve is held in place by attachment to a projection.

As shown in FIGS. 4 and 11, a locking pin system 52 may be configured to secure the pair of skis 26 and 28 to a training sled. The locking pin system 52 may include a pair of flanges 54 and 56 disposed proximate rear ends of each of the pair of skis 26 and 28 such that, when the skis 26 and 28 are slid into place under the training sled, the runners of the training sled each sit between a pair of flanges 54 and 56. The pairs of flanges 54 and 56 may be implemented with substantially flat rectangular plates formed of a rigid material such as aluminum or steel. The pairs of flanges 54 and 56 may be mechanically joined to the skis 26 and 28 by welding or other techniques known in the arts. Each of the flanges may include an aperture (for example, apertures 58 and 60 shown in FIGS. 2 and 5) configured to receive a pin. Each of the pairs of flanges 54 and 56 may be sized such that the apertures 58 and 60 are disposed above the runners when the skis 26 and 28 are slid into place under a training sled, thereby enabling placement of the pins 62 and 64 in the apertures 58 and 60 over the runners, further securing attachment of the ski accessory 112 to the sled. Placement of the flanges 54 and 56 on the skis may vary depending upon whether the skis are designed for a sled with a removable handlebar (see, e.g., FIG. 12) or for a sled without a removable handlebar (see, e.g., FIG. 13). As shown in FIG. 4, pins 62 and 64 may be operably attached to cables 66 and 68, such as by rings 70 and 72. The cables 66 and 68 may be operably attached to the ski rear crossbar 36, such as by nut 74 and bolt 76 or other conventional mechanical attachment mechanism.

As shown in FIG. 5, the ski accessory 112 may include a first pair of rollers 78 may be disposed proximate to the head ends of the pair of skis 26 and 28 and a second pair of rollers 80 may be disposed proximate to the rear ends of the pair of skis 26 and 28. The rollers 78 and 80 may be formed of a substantially hard material such as polyurethane or other hard rubber or plastic material capable of enabling smooth, low-friction travel over hard surfaces such as concrete or asphalt. The rollers 78 and 80 may be mechanically attached to the pair of skis 26 and 28 by a variety of conventional means known in the art. For example, the rollers 78 and 80 may be operably attached to an L-shaped bracket and the L-shaped bracket may be operably attached, such as by welding, bolting or other mechanical attachment mechanism, to the skis 26 and 28.

It is to be understood that the foregoing description is intended to illustrate and not to limit the scope of the invention, which is defined by the scope of the appended claims. Other embodiments are within the scope of the following claims. For example, all or portions of the training sled 10 and ski accessory 112 may be painted or powder coated for protection against the elements. While some components of the training sled 10 are described as "generally U-shaped," such as the attachment crossbar 84, the upper grip bar 86 and the U-shaped chassis formed by the runners 12 and 14 and the head crossbar 16, in alternative embodiments, the attachment crossbar, grip bar and chassis may be parabolic, arch-shaped, curved or of other similar shape appropriate to the purpose of the component. In still other alternative embodiments, the training sled 10 described herein may be configured to be sold with or without a removable handlebar 82. Similarly, the training sled 10 described herein may be configured to be sold with or without an attachment mechanism 110 for a removable device, such as harnesses, straps or ropes, etc.

Having described herein exemplary embodiments of the training sled with handlebar and ski accessories, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not be limited by the particular features which have been shown and described, but shall be construed also to cover any obvious modifications and equivalents thereof.

What is claimed is:

1. A training sled comprising:

a) an upper portion, including:

i) a pair of runners arranged in parallel relative to a center axis and a plane;

ii) a head crossbar extending between the runners near a first end of the runners and joined thereto;

iii) a weight bearing portion affixed to and extending between the pair of runners near mid-sections thereof; and iv) a rear crossbar extending between and disposed above the plane of the runners proximate second ends thereof and joined thereto opposite the head crossbar so as to present a rearward facing surface against which force may be applied; and b) a selectively removable modular ski assembly disposed beneath the runners of the upper portion including at least two skis attached to each other by at least one lateral crossbar, the modular ski assembly being removable to permit the training sled to be pushed or pulled on the bottom surface of the runners in a first mode of operation without the removable modular ski assembly, and in a second mode of operation with the removable modular ski assembly attached to permit the training sled to be pulled on the skis;

wherein relative movement between the upper portion and the selectively removable ski assembly is limited at least in part by a removable locking pin, and wherein the removable locking pin is disposed in a plurality of flanges on at least one of the skis near the back of the at least one ski, wherein the locking pin spans across the upper side of the ski and prevents a runner of the upper portion from sliding backwardly out of the ski assembly.

2. The training sled of claim 1, wherein the selectively removable modular ski assembly includes:

a) a friction-reducing layer disposed on a bottom portion of each of the pair of skis to permit the sled to be pulled on a smooth surface;

b) a first lateral crossbar extending between the skis near the front end of the ski assembly;

c) a second lateral crossbar extending between the skis near the rear and of the ski assembly; and d) a first attachment arm extending upwardly from the ski assembly to urge against the upper portion when the upper portion of the sled is pushed from the back or pulled from the front.

3. The training sled of claim 2, wherein the first attachment arm urges against the weight bearing member when the upper portion of the sled is pushed from the back or pulled from the front.

4. The training sled of claim 3, wherein a plurality of attachment arms are provided that slide over and urge against a forward portion of the weight bearing member when the upper portion of the sled is pushed from the back or pulled from the front.

5. The training sled of claim 1, wherein the pair of runners include elongated tubular members having a rounded cross section on a lower face thereof.

6. The training sled of claim 4, wherein the weight bearing member includes a plate attached at first and second ends to the pair of runners for supporting added weight to the training sled.

7. The training sled of claim 6, wherein the weight bearing member further includes a weight horn attached to the plate for receiving a plurality of weight plates.

8. The training sled of claim 2, wherein the friction-reducing layer is a high density carpet-like material.

9. The training sled of claim 1, further comprising:

a removable handlebar; and a pair of posts disposed on the second ends of the runners, wherein the pair of posts are configured to removably receive the removable handlebar.

10. The training sled of claim 9, wherein the removable handlebar includes:

an attachment crossbar configured to removably mate with the pair of posts disposed on the second ends of the runners; and an upper grip bar having a pair of substantially L-shaped legs, wherein the pair of substantially L-shaped legs are operably connected to the attachment crossbar.

11. The training sled of claim 1 wherein the selectively removable modular ski assembly further includes a first set of rollers disposed proximate to the head ends of the skis; and a second set of rollers disposed proximate to the rear ends of the skis.

12. A training sled comprising:

i) a pair of runners arranged in parallel relative to a center axis and a plane, the pair of runners having a front section inclined upwardly relative to a rear section;

ii) a head crossbar extending between first ends of the runners and joined thereto;

iii) a weight bearing portion affixed to and extending between the pair of runners near mid-sections thereof; and iv) a rear crossbar extending between and disposed above the plane of the runners proximate second ends thereof and joined thereto opposite the head crossbar so as to present a rearward facing gripping surface against which force may be applied by a user to push the sled at a first vertical height; and v) removable modular handlebar attached to the sled proximate the rear crossbar to provide a second gripping surface at a second vertical height different from the first vertical height, the sled being operable in (i) a first mode of operation with the removable handlebar removed to permit a user to push on the rear crossbar at the first vertical height to train a first grouping of muscles, and in (ii) a second mode of operation with the handlebar installed to permit a user to push on the removable handle at the second vertical height to train a second grouping of muscles.

13. The training sled of claim 12, wherein the training sled includes a pair of posts disposed on the second ends of the runners, wherein the pair of posts are configured to removably receive the removable handlebar.

14. The training sled of claim 13, wherein the removable handlebar includes:

an attachment crossbar configured to removably mate with the pair of posts disposed on the second ends of the runners; and an upper grip bar having a pair of substantially L-shaped legs, wherein the pair of substantially L-shaped legs are operably connected to the attachment crossbar.

15. The training sled of claim 13, wherein the removable handlebar includes:

an attachment crossbar configured to removably mate with the pair of posts disposed on the second ends of the runners;

a pair of L-shaped legs operably attached at first ends thereof to the attachment crossbar;

and a substantially straight grip bar operably attached to second ends of the pair of L-shaped legs.

16. The training sled of claim 13, wherein the removable handlebar includes:

an attachment crossbar configured to removably mate with the pair of posts disposed on the second ends of the runners;

a left-flared grip bar having an L-shaped lower portion operably attached to the attachment crossbar;

a right-flared grip bar having an L-shaped lower portion operably attached to the attachment crossbar; and an upper crossbar extending between and operably attached to the left-flared grip bar and the right-flared grip bar.

17. The training sled of claim 12, further comprising an anchor provided proximate the head crossbar for receiving at least one of ropes, cables and straps to the training sled.

18. The training sled of claim 12, wherein the handlebar presents a rearward facing surface against which force may be applied in a range from 8 inches to 40 inches above the plane of the runners.

* * * * *